US010955145B2

(12) United States Patent
Lach et al.

(10) Patent No.: US 10,955,145 B2
(45) Date of Patent: Mar. 23, 2021

(54) HEAT EXCHANGE SYSTEM AND METHOD OF CONTROLLING THE ALTERNATION AND REDUNDANCY BETWEEN HEAT EXCHANGERS THEREIN

(71) Applicant: MAXI-THERME INC., Anjou (CA)

(72) Inventors: Raymond Lach, Montreal (CA); Gabriel Cossette-Labrosse, Montreal (CA); Patrick Lach, Chambly (CA)

(73) Assignee: MAXI-THERME INC., Anjou (CA)

( * ) Notice: Subject to any disclaimer, the term of this patent is extended or adjusted under 35 U.S.C. 154(b) by 0 days.

(21) Appl. No.: 16/330,542

(22) PCT Filed: Feb. 27, 2018

(86) PCT No.: PCT/CA2018/050223

§ 371 (c)(1),
(2) Date: Mar. 5, 2019

(87) PCT Pub. No.: WO2019/165533

PCT Pub. Date: Sep. 6, 2019

(65) Prior Publication Data

US 2020/0408423 A1 Dec. 31, 2020

(51) Int. Cl.
*F28B 1/00* (2006.01)
*F24D 19/10* (2006.01)
(Continued)

(52) U.S. Cl.
CPC ..... *F24D 19/1051* (2013.01); *F28D 7/16* (2013.01); *F24D 17/0078* (2013.01);
(Continued)

(58) Field of Classification Search
USPC ..... 165/110
See application file for complete search history.

(56) References Cited

U.S. PATENT DOCUMENTS 3,779,306 A * 12/1973 Wilson ..... F22D 1/32 165/297
6,115,542 A * 9/2000 Nir ..... F23K 5/20 165/108

(Continued)

*Primary Examiner* — Kenneth J Hansen
*Assistant Examiner* — John E Bargero
(74) *Attorney, Agent, or Firm* — Shumaker, Loop & Kendrick, LLP; James D. Miller

(57) ABSTRACT

The heat exchange system is for heating water from a water source and comprises first and second flooded heat exchangers that have steam sides that are each independently fed with steam, but water sides that are serially fed with water through the first heat exchanger then through the second heat exchanger. The system also comprises first and second control valves located at or downstream of subcooled condensate outlets of the first and second heat exchangers, first and second water temperature sensors at or downstream of the heated water outlets of the first and second heat exchangers, and a control device for receiving temperature data from the first and second water temperature sensors and for controlling the first and second control valves. The proportions of the first and second steam sides that are flooded are respectively selectively adjusted by controlling the debit of condensate allowed through the first and second subcooled condensate outlets with the first and second control valves, for allowing heat exchange to the water to be adjusted as a result of the water temperature measured by the first and second water temperature sensors. The first and second control valves are set in one of a first state in which they are both at least partly opened to allow effective heat exchange from the steam to the water in both first and second heat exchangers, and a second state in which one of them is closed while the other is at least partly opened to have an effective heat exchange from the steam to the water in only one of the first or second heat exchangers while the first and second steam sides remain both supplied with steam.

7 Claims, 2 Drawing Sheets

(51) Int. Cl.
*F28D 7/16* (2006.01)
*F24D 17/00* (2006.01)
*F28B 7/00* (2006.01)

(52) U.S. Cl.
CPC ..... *F24D 2220/0207* (2013.01); *F24D 2220/0271* (2013.01); *F24D 2220/042* (2013.01); *F28B 7/00* (2013.01)

(56) References Cited

U.S. PATENT DOCUMENTS

| | | | | |
|---|---|---|---|---|
| 8,955,763 | B2 * | 2/2015 | Zirkiyev | G05D 23/1923 237/8 A |
| 2004/0154786 | A1 | 8/2004 | Lach | |
| 2007/0119962 | A1 | 5/2007 | Peckham et al. | |
| 2016/0069625 | A1 * | 3/2016 | Deacon | F28F 27/02 165/96 |
| 2016/0252307 | A1 | 9/2016 | Lach | |
| 2017/0336067 | A1 * | 11/2017 | Wieland | F01K 25/08 |
| 2019/0264957 | A1 * | 8/2019 | Petersen | F25B 25/005 |

* cited by examiner

HEAT EXCHANGE SYSTEM AND METHOD OF CONTROLLING THE ALTERNATION AND REDUNDANCY BETWEEN HEAT EXCHANGERS THEREIN

FIELD OF THE INVENTION

The present invention relates to a heat exchange system that uses steam to heat water or another liquid, and more particular to a heat exchange system that uses redundant flooded heat exchangers that can be alternated.

BACKGROUND OF THE INVENTION

Heat exchangers are used to heat water or another liquid. In the present specification, although reference may be made to water, it is understood that the liquid to be heated might be any other liquid (glycol, etc . . . ) without departing from the present invention. The water is heated by circulating steam in a steam side that is in heat exchange relationship with a water side. The change of the steam from vapor state to liquid state provides an efficient heat transfer since the change of state is highly exothermic.

Conventional heat exchangers circulate steam in the shell side to heat the water that is circulated in tubes that represent the water side. Some heat exchangers however have the water circulate in the shell and the steam in the tubes, so both are possible for the respective water and steam sides. The water temperature is measured at the heated water outlet, and steam debit is controlled at the steam inlet by one or more control valves to obtain more or less heat exchange depending on the incoming steam debit that will be adjusted to obtain the desired heated water temperature at the water outlet.

Heat exchangers can be used for numerous applications such as for providing hot tap water (e.g. for showers in a hotel) or for heating a building by circulating hot water through water pipes throughout the building. In any event, two redundant heat exchangers are typically installed in two parallel branches. Often, either the first or the second heat exchanger will be used in alternation; and in some instances, both heat exchangers are used simultaneously. The reason for these redundant heat exchangers where a single one suffices for the required load, is that if one must be shut down for maintenance or replacement, the other must be able to heat the water meanwhile.

Also, it is known not to have dedicated "active" and "backup" heat exchangers, but rather to use the two redundant heat exchangers in alternation. Indeed, using one active heat exchanger continuously to the detriment of the other could lead to the situation where when shutdown of the active heat exchanger occurs, the backup heat exchanger is suddenly found to be non-operable for one reason or another. Also the life cycle of the active heat exchanger is likely to be shorter, requiring replacement sooner if it is used exclusively.

The alternation between heat exchangers means that, at regular time intervals, one is shut down and the other is activated instead. This approximately equal split between use of two parallel heat exchangers is called the equal run time procedure.

There are problems associated to the alternation between heat exchangers to allow equal run time. Indeed, when a switch between heat exchangers occurs, the previously unused heat exchanger needs to be initialized, i.e. water to be heated and steam are supplied to it while it is still cold. Injecting steam in the cold heat exchanger results in mechanical stress due to the steam entering a cold environment and there resulting contraction/expansion of parts. This will stress the mechanical joints that can, and often do, leak, such that it is normal procedure to have an operator verify all the numerous heat exchanger bolts that attach its parts together, with a special tool that is used to measure the torque on the bolts according to industry standards, and tighten the bolts if necessary, every time a heat exchanger is initialised. In practice, if heat exchangers were only stopped and started up again once a year, this would not be very time-consuming overall; but with the equal run-time procedure operators often wish to switch between heat exchangers much more often, for example once per week. Moreover, insulation often covers the entire heat exchangers, even if it shouldn't, to save money by reducing loss of heat with ambient air; and removing the insulation when starting up the heat exchangers to verify and tighten the bolts takes even more time, and is complex to accomplish without damaging the insulation. Alternation between heat exchangers is consequently time-consuming. Also, in practice operators often simply don't verify the torque on the bolts when this is required frequently, which leads to more leaks and eventual breakdowns.

One solution would be to continuously use two heat exchangers simultaneously in parallel, to avoid having to shut one down while the other is used. However, this solution is suboptimal. Indeed, each heat exchanger being capable of supporting the full load of the application where it is used in case of the breakdown or maintenance of the other heat exchanger, using both simultaneously in parallel would mean splitting the load in two to obtain the desired water temperature. During normal use, when the full load is not required—which is the vast majority of the time—the heat exchangers would then be used at, say, 10-20% of their maximum load. This brings the heat exchangers in suboptimal load operational ranges, leading to important temperature instability, in itself undesirable for the users; but also this in turn leads to overheating the water which often means thousands of dollars spent uselessly per year because overheating means using more steam which in turn requires more energy.

Another solution would be to install the conventional heat exchangers in series, but again this solution is suboptimal for the same reasons: since each heat exchanger would need to be usable alone, when both are used each would operate at low load resulting in the problems identified above, namely temperature instability and overheating, resulting in energy loss.

Usual efficient operational load range targets in conventional heat exchangers are usually about 30-70% of full load, or at most 20-80%. Outside of those ranges, the heat exchangers function sub-optimally.

It is consequently well known in the field of steam heating to avoid using conventional heat exchangers simultaneously in series or in parallel for the reason of avoiding usage in suboptimal operational loads; and the best solution that has been found yet has been to use two heat exchangers in parallel and to alternate between the two heat exchangers in equal run time, even if that means initialising one off from cold each time an alternation is done, e.g. every week.

It has also become known in the recent years to use so-called vertical flooded heat exchangers instead of conventional horizontal non-flooded heat exchangers, wherein water is circulated in the tubes and steam is circulated in the shell or vice-versa. The flooded heat exchanger is installed vertically and is designed to allow the steam to condense within the heat exchanger shell, with the condensate flowing downwards towards where the condensate outlet is located. The condensate is subcooled, i.e. is cooled to a temperature below the boiling point, and provides additional heat transfer to the water while avoiding that there be re-evaporation of the condensate. This increases the heat exchange efficiency even more: indeed, the subcooled condensate allows additional heat transfer in addition to the normal gas stage to liquid stage steam condensation that also occurs in flooded heat exchangers. A control valve is located at the subcooled condensate outlet on the steam side. By controlling the opening of the subcooled condensate control valve, the level of liquid condensate vs. the level of vapor phase steam is controlled and the heat transfer between the steam side and the water side is also controlled. The level of liquid-phase condensate is also called the level of flooding, hence the expression "flooded heat exchanger". Use of flooded heat exchangers is relatively recent.

Probably based on the history of usage of dual conventional heat exchangers, dual flooded heat exchangers are also installed in parallel, with either one of the two heat exchangers being used at any time. The same problems occur as with conventional heat exchangers when alternation occurs, i.e. leakage and mechanical stress.

SUMMARY OF THE INVENTION

The present invention relates to a heat exchange system for heating water from a water source, comprising:

- a first flooded heat exchanger comprising:
  - a first steam side extending through said first heat exchanger between a first steam inlet and a first subcooled condensate outlet, said first steam inlet for receiving steam and for allowing steam to flow through said first steam side and to condense to form condensate that at least partly floods said first steam side and that flows out through said first subcooled condensate outlet; and
  - a first water side in heat exchange relationship with said first steam side and extending through said first heat exchanger between a first cold water inlet and a first heated water outlet, said first cold water inlet being connected to said water source for receiving water and for allowing water to flow through said first water side, to be heated therein by heat exchange with said first steam side and to flow out through said first heated water outlet;
- a second flooded heat exchanger comprising:
  - a second steam side extending through said second heat exchanger between a second steam inlet and a second subcooled condensate outlet, said second steam inlet for receiving steam and for allowing steam to flow through said second steam side and to condense to form condensate that at least partly floods said second steam side and that flows out through said second subcooled condensate outlet; and
  - a second water side serially connected to said first water side, said second water side being in heat exchange relationship with said second steam side and extending through said second heat exchanger between a second cold water inlet and a second heated water outlet, said second cold water inlet being connected to said first heated water outlet for receiving water and for allowing water to flow through said second water side, to be heated therein by heat exchange with said second steam side and to flow out through said second heated water outlet;
- a first control valve located at or downstream of said first subcooled condensate outlet;
- a second control valve located at or downstream of said second subcooled condensate outlet;
- a first water temperature sensor at or downstream of said first heated water outlet, albeit upstream of said second heat exchanger;
- a second water temperature sensor at or downstream of said second heated water outlet; and
- a control device for receiving temperature data from said first and second water temperature sensors and for controlling said first and second control valves; wherein the proportions of said first and second steam sides that are flooded are respectively selectively adjusted by controlling the debit of condensate allowed through said first and second subcooled condensate outlets with said first and second control valves, for allowing heat exchange to the water to be adjusted as a result of the water temperature measured by said first and second water temperature sensors; and wherein said first and second control valves are selectively set in one of a first state in which they are both at least partly opened to allow effective heat exchange from the steam to the water in both first and second heat exchangers, and a second state in which one of them is closed while the other is at least partly opened to have an effective heat exchange from the steam to the water in only one of said first or second heat exchangers while the first and second steam sides remain both supplied with steam.

In one embodiment, the heat exchange system further comprises isolation valves upstream and downstream of each of said first and second steam sides and of each of said first and second water sides, such that said first and second steam and water sides can be independently shut off to allow maintenance or replacement of one of said first and second heat exchangers while the other remains operational.

In one embodiment, the heat exchange system further comprises a first recirculation line connecting said second heated water outlet to said first cold water inlet for allowing water to be at least partly recirculated therebetween, and a second recirculation line connecting said second heated water outlet to said second cold water inlet for allowing water to be at least partly recirculated therebetween.

In one embodiment, said first and second recirculation lines comprise respective first and second recirculation pumps.

In one embodiment, steam flowing to said first and second steam inlets is fed from a same steam source.

In one embodiment, condensate flowing out from said first and second subcooled condensate outlets is merged and discharged through a same condensate return.

The invention also relates to a method of controlling the alternation and redundancy, in a heat exchange system as defined hereinabove, between the first and second heat exchangers, comprising:

- continuously supplying with steam the first and second steam sides that are connected in parallel;
- continuously circulating the water through said first and second water sides that are connected in series;
- selecting one of the first and second states of the first and second valves, wherein:
  - in the first state the first and second heat exchangers both provide effective heat transfer to the water, and in the second state a single one of the first and second heat exchangers provide effective heat transfer to the water; and in the second state the method further comprising alternating the effective heat transfer between the first and second heat exchangers by alternately opening the first and second control valves at selected time intervals.

DETAILED DESCRIPTION OF THE EMBODIMENTS

The present invention proposes the use of dual flooded heat exchangers with the water to be heated running serially through both flooded heat exchangers at all times, while the steam is continuously supplied in both heat exchangers but, by selectively closing one condensate outlet valve, the effective heat transfer only occurs at one of the two heat exchangers. Both heat exchangers being operative at all times means that either both heat exchangers can be used in alternation, wherein no initialisation of the other heat exchanger when a switch occurs and consequently the invention has the advantages of both equal run time alternation and no initialisation of heat exchangers; or both heat exchangers can be used simultaneously, notably under high load periods, again without initialisation of the second heat exchanger.

As mentioned above, although water is mentioned as the liquid to be cooled, any other liquid can also be circulated such as glycol for example.

Figure 1:
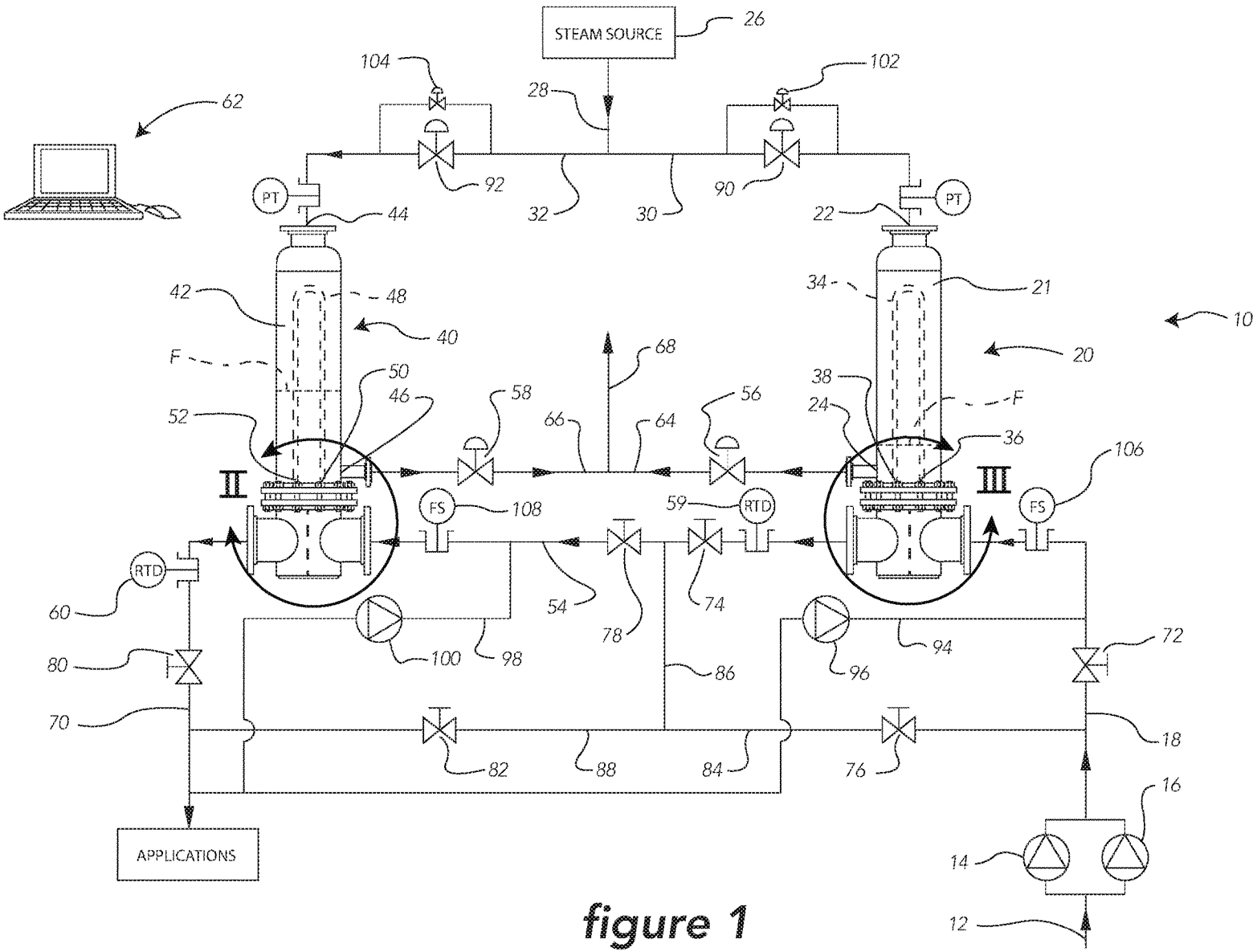
FIG. 1 is a schematic view of the heat exchange system of the present invention.
Figure 3:
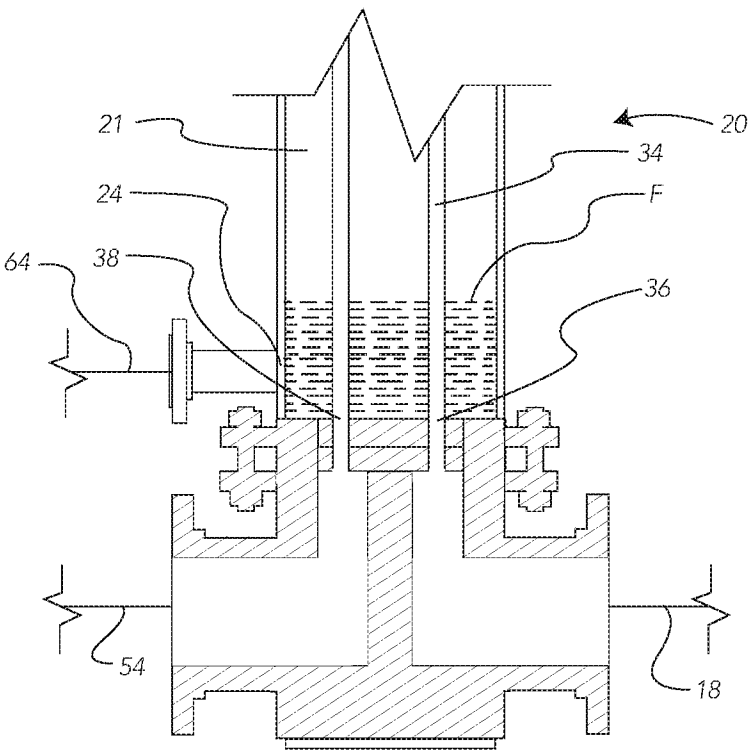
FIGS. 2 and 3 are enlarged schematic cross-section views of the areas respectively circumscribed by circles II and III in FIG. 1.
Figure 2:
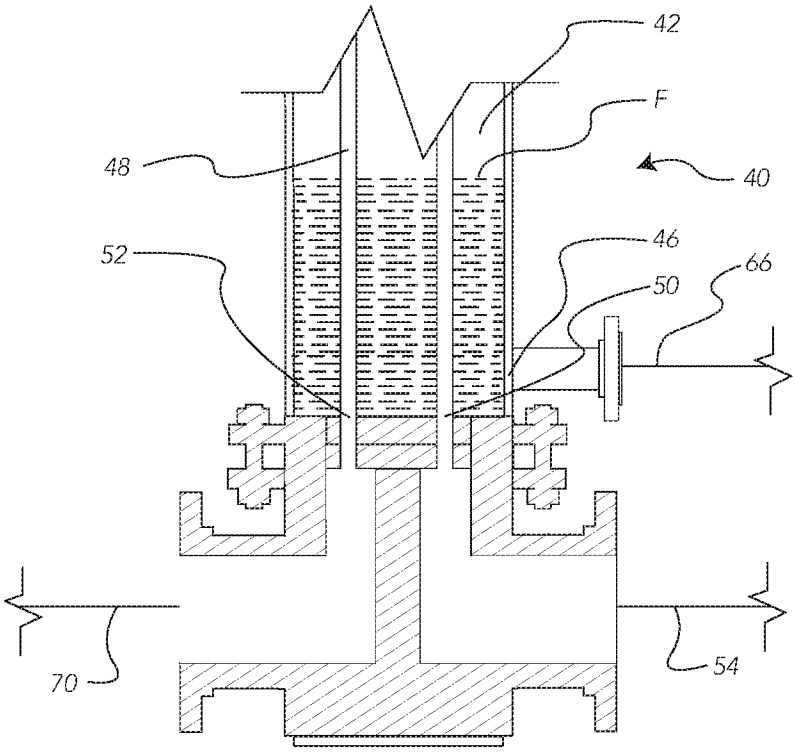

More particularly, the present invention comprises a heat exchange system 10 as shown in FIGS. 1-3 for heating water from a water source 12. Depending on the application for which heated water is required, the water source can be tap water, or water returning through a circuit to the heat exchange system 10 after having been circulated in a closed loop through application segments for example for heating rooms in a building.

Heat exchange system 10 comprises one or more pumps to help circulate the water in the heat exchange system 10, with two pumps 14, 16 here being shown for redundancy but a single one would suffice. Pump 14 or 16 pumps water from water source 12 through a first water inlet line 18 that is connected to a first flooded heat exchanger 20 as described hereinafter. The pump or pumps could alternately be located downstream of heat exchangers 20, 40, or outside the heat exchange system 10 itself, i.e. the heat exchange system 10 can be retrofitted in a circuit where water is circulated with existing pumps, for instance by using municipal tap water.

First flooded heat exchanger 20 comprises a first steam side 21 in the exchanger shell side, extending through first heat exchanger 20 between a first steam inlet 22 and a first subcooled condensate outlet 24. First steam inlet 22 is for receiving steam and for allowing steam to flow through first steam side 21 and to condense to form condensate that at least partly floods first steam side 21 to a variable level of flooding F and that is subcooled by additional heat transfer to the water before flowing out through first subcooled condensate outlet 24. Steam is fed from a steam source 26, such as a boiler for example, through a main steam inlet line 28 that splits into first and second steam inlet lines 30, 32, with first steam inlet line being connected to first steam inlet 22.

First flooded heat exchanger 20 also comprises a first water side 34 in the exchanger tube side, in heat exchange relationship with first steam side 21 and extending through first heat exchanger 20 between a first cold water inlet 36 and a first heated water outlet 38, first cold water inlet 36 being connected to the water source and more particularly to first water inlet line 18 for receiving water and for allowing water to flow through first water side 34, to be heated therein by heat exchange with first steam side 21 and to flow out through first heated water outlet 38.

Heat exchange system 10 further comprises a second flooded heat exchanger 40 that is similar to first flooded heat exchanger 20. Second flooded heat exchanger 40 comprises a second steam side 42 in the exchanger shell side, extending through second heat exchanger 40 between a second steam inlet 44 that is connected to second steam inlet line 32 and a second subcooled condensate outlet 46, second steam inlet 44 being for receiving steam from the steam source 26 and for allowing steam to flow through second steam side 42 and to condense to form condensate that at least partly floods second steam side 42 at a level of flooding F (that may be the same as the level of flooding F of the first heat exchanger 20, but more probably not) and that is subcooled by additional heat transfer to the water before flowing out through second subcooled condensate outlet 46.

Second flooded heat exchanger 40 also comprises a second water side 48 in the exchanger tube side, in heat exchange relationship with second steam side 42 and extending through second heat exchanger 40 between a second cold water inlet 50 and a second heated water outlet 52. Second cold water inlet 50 is serially connected to first water side 34, and more particularly an intermediate line 54 extends and links the first heated water outlet 38 to the second cold water inlet 50, such that water can flow from first water side 34, through intermediate line 54 and into and through second water side 48, where it will be heated by heat exchange with second steam side 42 before flowing out through second heated water outlet 52.

Heat exchange system 10 also comprises a first control valve 56 located at or downstream of first condensate outlet 24; and a second control valve 58 located at or downstream of second condensate outlet 46. A first water temperature sensor 59 is provided at or downstream of first heated water outlet 38, albeit upstream of second heat exchanger 40; and a second water temperature sensor 60 is provided at or downstream of second heated water outlet 52. A control device 62 receives temperature data from first and second water temperature sensors 59, 60 and controls first and second control valves 56, 58.

First and second subcooled condensate outlets 24, 46 lead into respective first and second condensate outlet lines 64, 66 that merge into a main condensate outlet line 68 that leads to a suitable condensate discharge (not shown). For instance, main condensate outlet line 68 can lead back to a main condensate return line that in turn leads back to steam source 26, or could be discharged in a municipal sewer conduit.

Second heated water outlet 52 leads into a heated water line 70 that in turn conveys the water to applications where heated water is required. If the applications do not use the water itself, e.g. in building heating applications, then the water may be circulated back to water source 12 to be heated again.

In FIG. 1, a single tube is shown to represent the water side, but it is understood that numerous tubes normally form the tube side. Also, although a U-tube configuration is shown in FIG. 1, in an alternate embodiment (not shown), the tubes could be straight instead or other suitable tube configuration.

In another alternate embodiment (not shown), the water could circulated in the shell instead and the steam could be circulated in the tubes instead.

First and second condensate control valves 56, 58 are said to be located at or downstream of subcooled condensate outlet 38, 46 because any position along their respective lines 64, 66 is substantially equivalent as will be obvious for someone skilled in the art. Likewise, first and second water temperature sensors 59, 60 are said to be located at or downstream of heated water outlets 38, 52, albeit upstream of second heat exchanger 40 in the case of first sensor 59, because any position along their respective lines 54, 70 is substantially equivalent as will be obvious for someone skilled in the art.

In use, to heat water within heat exchange system 10 to a desired temperature, the proportions of each of first and second steam sides 21, 42 that are flooded can be respectively selectively adjusted by controlling the debit of subcooled condensate allowed through first and second subcooled condensate outlets 24, 46 with first and second control valves 56, 58, for allowing heat exchange to the water to be adjusted as a result of the water temperature measured by first and second water temperature sensors 59, 60.

More specifically, first and second control valves 56, 58 can be set in one of a first state in which they are both at least partly opened (at respective opening percentages, that can be identical or, more likely, different) to allow effective heat exchange from the steam to the water in both first and second heat exchangers 20, 40; and a second state in which one of them is closed while the other is at least partly opened to have an effective heat exchange from the steam to the water in only one of first or second heat exchangers 20, 40, while the first and second steam sides 21, 42 remain continuously supplied with steam.

The heat exchange system 10 consequently allows controlling both the alternation and the redundancy between first and second heat exchangers 20, 40, by continuously supplying with steam the first and second steam sides 21, 42 that are connected in parallel, namely in two parallel branches of the steam circuit; and by continuously circulating the water through both the first and second water sides 34, 48 that are connected in series, namely the water circulates through the first and then the second heat exchangers 20, 40 one after the other.

In the first state of control valves 56, 58 where both are opened and effective heat exchange occurs between steam and water in both heat exchangers 20, 40, there is effective heat transfer in both the first and second heat exchangers 20, 40 between the steam and the water. This allows usage of heat exchange system at peak demand times where high hot water debit is required.

In the second state of control valves 56, 58 where one is open and the other is closed, a single one of the first and second heat exchangers 20, 40 provides effective heat transfer between the steam and the water. Here, it becomes possible to alternate the effective heat transfer between the first and second heat exchangers 20, 40 under equal run time procedures, by alternately opening the first and second control valves 56, 58 at desired time intervals, e.g. alternation can occur every day or every week. However, the steam remains continuously supplied to the heat exchanger 20 or 40 that is not operatively transferring heat, this heat exchanger does not need to be initialized when alternation occurs. The mechanical stress on it is reduced because of this "warm" start.

Heat exchange system 10 of course allows each heat exchanger 20, 40 to be used alone in case of maintenance or replacement of the other. To this end, isolation valves 72, 74, 76, 78, 80, 82 are provided on inlet water line 18, intermediate water line 54, outlet water line 70 and on dedicated isolation lines 84, 86, 88. In normal operation of heat exchange system 10, valves 76, 82 are closed and water is circulated in series through both heat exchangers 20, 40 as described above. By closing isolation valves 72, 74 and opening valve 76, water can bypass the first heat exchanger 20 entirely; or by closing valves 78, 80 and opening valve 82, water can bypass second heat exchanger 40 entirely.

Control valves 56, 58 if closed can be used to isolate their respective heat exchanger 20, 40, in conjunction with first and second steam shut-off valves 90, 92 that are provided on the steam inlet lines 30, 32 respectively. Steam shut-off valves 90, 92 are required on any steam exchanger 20, 40 as normal components, to allow steam to be selectively shut off or automatically shut off in case of system failure. Here, they further serve to isolate the steam sides 21, 42 in conjunction with control valves 56, 58.

First and second and water sides 34, 48 and first and second steam sides 21, 42 can consequently be shut off to allow maintenance or replacement of one of first and second heat exchangers 20, 40 while the other remains operational. The usual redundancy of heat exchangers 20, 40 consequently exists with the present invention.

Heat exchange system 10 optionally comprises, as shown in FIG. 1, a first recirculation line 94 equipped with an optional first recirculation pump 96 connecting second heated water outlet 52 to first cold water inlet 36 for allowing water to be at least partly recirculated therebetween, and a second recirculation line 98 equipped with an optional second recirculation pump 100 connecting second heated water outlet 52 to second cold water inlet 50 for allowing water to be at least partly recirculated therebetween. In heat exchangers 20, 40 where effective heat transfer occurs, a portion of the heated water is optionally advantageously recirculated to the cold water inlet to increase temperature stability at times of varying demand.

First and second steam inlet start-up valves 102, 104 are advantageously provided to allow low debit and low pressure gradual injection of steam when the corresponding first and second heat exchangers 20, 40 are initialized (e.g. after initial installation or maintenance).

First and second security flow sensors 106, 108 are provided at first and second cold water inlets 36 and 50 to detect the eventual absence of water running into the first and second heat exchangers 20 and 40. Control device 62 would then command the closure of shut-off valves 90, 92 to avoid the heat exchangers 20, 40 from overheating. Flow sensors 106, 108 could alternately be installed at the heat exchanger outlets 38, 52 instead.

In an alternate embodiment (not shown), the heat exchange system of the present invention includes three or more heat exchangers instead of two, where the water sides of all heat exchangers are in series and the steam sides, in parallel.

The invention claimed is:

1. A heat exchange system for heating water from a water source, comprising: "a first flooded heat exchanger comprising: a first steam side extending through said first heat exchanger between a first steam inlet and a first subcooled condensate outlet, said first steam inlet for receiving steam and for allowing steam to flow through said first steam side and to condense to form condensate that at least partly floods said first steam side and that flows out through said first subcooled condensate outlet; and a first water side in heat exchange relationship with said first steam side and extending through said first heat exchanger between a first cold water inlet and a first heated water outlet, said first cold water inlet being connected to said water source for receiving water and for allowing water to flow through said first water side, to be heated therein by heat exchange with said first steam side and to flow out through said first heated water outlet;" a second flooded heat exchanger comprising: a second steam side extending through said second heat exchanger between a second steam inlet and a second subcooled condensate outlet, said second steam inlet for receiving steam and for allowing steam to flow through said second steam side and to condense to form condensate that at least partly floods said second steam side and that flows out through said second subcooled condensate outlet; and a second water side serially connected to said first water side, said second water side being in heat exchange relationship with said second steam side and extending through said second heat exchanger between a second cold water inlet and a second heated water outlet, said second cold water inlet being connected to said first heated water outlet for receiving water and for allowing water to flow through said second water side, to be heated therein by heat exchange with said second steam side and to flow out through said second heated water outlet; "a first control valve located at or downstream of said first subcooled condensate outlet;" a second control valve located at or downstream of said second subcooled condensate outlet; "a first water temperature sensor at or downstream of said first heated water outlet, albeit upstream of said second heat exchanger;" a second water temperature sensor at or downstream of said second heated water outlet; and "a control device for receiving temperature data from said first and second water temperature sensors and for controlling said first and second control valves; wherein proportions of said first and second steam sides that are flooded are respectively selectively adjusted by controlling a debit of condensate allowed through said first and second subcooled condensate outlets with said first and second control valves, for allowing heat exchange to the water to be adjusted as a result of the water temperature measured by said first and second water temperature sensors; and wherein said first and second control valves are selectively set in one of a first state in which they are both at least partly opened to allow effective heat exchange from the steam to the water in both first and second heat exchangers, and a second state in which one of them is closed while the other is at least partly opened to have an effective heat exchange from a steam to a water in only one of said first or second heat exchangers while the first and second steam sides remain both supplied with steam.

2. A heat exchange system as defined in claim 1, further comprising isolation valves upstream and downstream of each of said first and second steam sides and of each of said first and second water sides, such that said first and second steam and water sides can be independently shut off to allow maintenance or replacement of one of said first and second heat exchangers while the other remains operational.

3. A heat exchange system as defined in claim 1, further comprising a first recirculation line connecting said second heated water outlet to said first cold water inlet for allowing water to be at least partly recirculated therebetween, and a second recirculation line connecting said second heated water outlet to said second cold water inlet for allowing water to be at least partly recirculated therebetween.

4. A heat exchange system as defined in claim 3, wherein said first and second recirculation lines comprise respective first and second recirculation pumps.

5. A heat exchange system as defined in claim 1, wherein the steam flowing to said first and second steam inlets is fed from a same steam source.

6. A heat exchange system as defined in claim 1, wherein condensate flowing out from said first and second subcooled condensate outlets is merged and discharged through a same condensate return.

7. A method of controlling the alternation and redundancy, in a heat exchange system as defined in claim 1, between the first and second heat exchangers, comprising:

- continuously supplying with steam the first and second steam sides that are connected in parallel;
- continuously circulating the water through said first and second water sides that are connected in series;
- selecting one of the first and second states of the first and second valves, wherein:
  - in the first state the first and second heat exchangers both provide effective heat transfer to the water, and in the second state a single one of the first and second heat exchangers provide effective heat transfer to the water; and
  - in the second state the method further comprising alternating the effective heat transfer between the first and second heat exchangers by alternately opening the first and second control valves at selected time intervals.

* * * * *